US006331341B1

(12) United States Patent
Joyce

(10) Patent No.: US 6,331,341 B1
(45) Date of Patent: Dec. 18, 2001

(54) MULTIAXIAL PRESS FABRIC HAVING SHAPED YARNS

(75) Inventor: Michael J. Joyce, Clifton Park, NY (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/350,398

(22) Filed: Jul. 9, 1999

(51) Int. Cl.[7] ..... B28B 3/10; D21F 3/00

(52) U.S. Cl. ..... 428/138; 428/131; 442/196; 442/270; 442/271; 162/358.2; 162/900

(58) Field of Search ..... 162/900, 358.2; 442/196, 269, 271, 270; 428/102, 121, 131, 138

(56) References Cited

U.S. PATENT DOCUMENTS

| | | | | |
|---|---|---|---|---|
| 4,107,367 | * | 8/1978 | Fekete | 442/268 |
| 4,414,263 | | 11/1983 | Miller et al. . | |
| 4,438,788 | | 3/1984 | Harwood . | |
| 5,023,132 | | 6/1991 | Stanley et al. . | |
| 5,089,324 | | 2/1992 | Jackson . | |
| 5,204,171 | | 4/1993 | Eschmann . | |
| 5,268,076 | | 12/1993 | Best et al. . | |
| 5,360,656 | | 11/1994 | Rexfelt et al. . | |
| 5,368,696 | * | 11/1994 | Cunnane, III et al. | 442/270 |
| 5,601,691 | | 2/1997 | Kufferath . | |
| 5,785,818 | * | 7/1998 | Fekete et al. | 162/900 |
| 5,998,310 | * | 12/1999 | Bowen, Jr. | 442/196 |

* cited by examiner

*Primary Examiner*—Terrel Morris
*Assistant Examiner*—Jenna-Leigh Befumo
(74) *Attorney, Agent, or Firm*—Pitney, Hardin, Kipp & Szuch LLP

(57) ABSTRACT

A multiaxial press fabric includes a base fabric and a plurality of layers of staple fiber material attached to the base fabric. The base fabric has at least one layer assembled by spirally winding a woven fabric strip, and takes the form of an endless loop. Because of the spiral winding, the yarns of the woven fabric strip lie in directions different from the machine- and cross-machine directions of the base fabric, giving the base fabric multiaxial characteristics. The woven fabric strip includes, in at least one of its lengthwise and crosswise directions, shaped yarns, which are either hollow yarns or yarns having a non-circular cross section.

33 Claims, 6 Drawing Sheets

MULTIAXIAL PRESS FABRIC HAVING SHAPED YARNS

BACKGROUND OF THE INVENTION

1. Field of the Invention

The present invention relates to the papermaking arts. More specifically, the present invention relates to press fabrics for the press section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, nonwoven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a papermachine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting or welding. Alternatively, adjacent longitudinal edge portions of adjoining spiral turns may be arranged overlappingly, so long as the edges have a reduced thickness, so as not to give rise to an increased thickness in the area of the overlap. Further, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine)) direction, is the result. The lateral edges of the woven base fabric are then trimmed to render them parallel to its longitudinal (machine) direction. The angle between the machine direction of the woven base fabric and the helically continuous seam may be relatively small, that is, typically less than 10°. By the same token, the lengthwise (warp) yarns of the woven fabric strip make the same relatively small angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filling) yarns of the woven fabric strip align with the longitudinal (machine) or transverse (cross-machine) directions of the woven base fabric.

In the method shown in U.S. Pat. No. 5,360,656, the woven fabric strip is wound around two parallel rolls to assemble the woven base fabric. It will be recognized that endless base fabrics in a variety of widths and lengths may be provided by spirally winding a relatively narrow piece of woven fabric strip around the two parallel rolls, the length of a particular endless base fabric being determined by the length of each spiral turn of the woven fabric strip, and the width being determined by the number of spiral turns of the woven fabric strip. The prior necessity of weaving complete base fabrics of specified lengths and widths to order may thereby be avoided. Instead, a loom as narrow as 20 inches (0.5 meters) could be used to produce a woven fabric strip, but, for reasons of practicality, a conventional textile loom having a width of from 40 to 60 inches (1.0 to 1.5 meters) may be preferred.

U.S. Pat. No. 5,360,656 also shows a press fabric comprising a base fabric having two layers, each composed of a spirally wound strip of woven fabric. Both layers take the form of an endless loop, one being inside the endless loop formed by the other. Preferably, the spirally wound strip of woven fabric in one layer spirals in a direction opposite to that of the strip of woven fabric in the other layer. That is to say, more specifically, the spirally wound strip in one layer defines a right-handed spiral, while that in the other layer defines a left-handed spiral. In such a two-layer, laminated base fabric, the lengthwise (warp) yarns of the woven fabric strip in each of the two layers make relatively small angles with the longitudinal (machine) direction of the woven base fabric, and the lengthwise (warp) yarns of the woven fabric strip in one layer make an angle with the lengthwise (warp) yarns of the woven fabric strip in the other layer. Similarly, the crosswise (filling) yarns of the woven fabric strip in each of the two layers make relatively small angles with the transverse (cross-machine) direction of the woven base fabric, and the crosswise (filling) yarns of the woven fabric strip in one layer make an angle with the crosswise (filling) yarns of the woven fabric strip in the other layer. In short, neither the lengthwise (warp) nor the crosswise (filling) yarns of the woven fabric strip in either layer align with the longitudinal (machine) or transverse (cross-machine) directions of the base fabric. Further, neither the lengthwise (warp) nor the crosswise (filling) yarns of the woven fabric strip in either layer align with those of the other.

As a consequence, the base fabrics shown in U.S. Pat. No. 5,360,656 have no defined machine- or cross-machine-direction yarns. Instead, the yarn systems lie in directions at oblique angles to the machine and cross-machine directions. A press fabric having such a base fabric may be referred to as a multiaxial press fabric. Whereas the standard press fabrics of the prior art have three axes: one in the machine direction (MD), one in the cross-machine direction (CD), and one in the Z-direction, which is through the thickness of the fabric, a multiaxial press fabric has not only these three axes, but also has at least two more axes defined by the directions of the yarn systems in its spirally wound layer or layers. Moreover, there are multiple flow paths in the Z-direction of a multiaxial press fabric. As a consequence, a multiaxial press fabric has at least five axes. Because of its multiaxial structure, a multiaxial press fabric having more than one layer exhibits superior resistance to nesting and/or to collapse in response to compression in a press nip during the papermaking process as compared to one having base fabric layers whose yarn systems are parallel to one another.

The present invention is an improved multiaxial press fabric having a base fabric of the foregoing type. The base fabric, or, more particularly, the strip of woven fabric from which the base fabric is assembled, includes shaped yarns in at least one of its lengthwise (warp) and crosswise (filling) directions. The shaped yarns may be either hollow yarns or yarns of non-circular cross section.

SUMMARY OF THE INVENTION

In its broadest form, the present multiaxial press fabric for the press section of a paper machine comprises a base fabric having at least one layer formed by spirally winding a fabric strip. The fabric strip is woven from lengthwise yarns and crosswise yarns.

At least one of the lengthwise yarns and crosswise yarns are shaped yarns. The shaped yarns are either hollow yarns or yarns of a non-circular cross section. The non-circular cross section may be of a substantially rectangular shape or may have a plurality of lobes.

The fabric strip has a first lateral edge and a second lateral edge, and is spirally wound in a plurality of contiguous turns wherein the first lateral edge in a turn of the fabric strip abuts the second lateral edge of an adjacent turn thereof. A helically continuous seam separating adjacent turns of the fabric strip is thereby formed. The helically continuous seam is closed by attaching abutting first and second lateral edges of the fabric strip to one another. In this manner, a base fabric in the form of an endless loop having a machine direction, a cross-machine direction, an inner surface and an outer surface is provided.

The base fabric may comprise one or more additional layers formed by spirally winding fabric strips, which are woven from lengthwise yarns and crosswise yarns. As above, at least one of the lengthwise yarns and the crosswise yarns may be shaped yarns.

The additional fabric strip or strips also have first lateral edges and second lateral edges, and are spirally wound in a plurality of contiguous turns wherein the first lateral edge in a turn of each additional fabric strip abuts the second lateral edge of an adjacent turn thereof. Helically continuous seams separating adjacent turns of the additional fabric strips are thereby formed. The helically continuous seams are closed by attaching abutting first and second lateral edges of each additional fabric strip to one another. In this manner, one or more additional layers in the form of endless loops having a machine direction, a cross-machine direction, an inner surface and an outer surface are provided. Preferably, at least some of the additional fabric strips are spirally wound in a direction opposite to that in which the first fabric strip is spirally wound. The endless loops formed by the additional layer or layers are disposed around the endless loop formed by the first layer.

A plurality of layers of staple fiber material is attached to one or both of the inner and outer surfaces of the base fabric. At the same time, where the base fabric includes more than one layer, the layers are attached to one another by individual fibers of the staple fiber material needled therethrough.

The present invention will now be described in more complete detail with frequent reference being made to the figures identified below.

DETAILED DESCRIPTION OF THE PREFERRED EMBODIMENT

Figure 1:
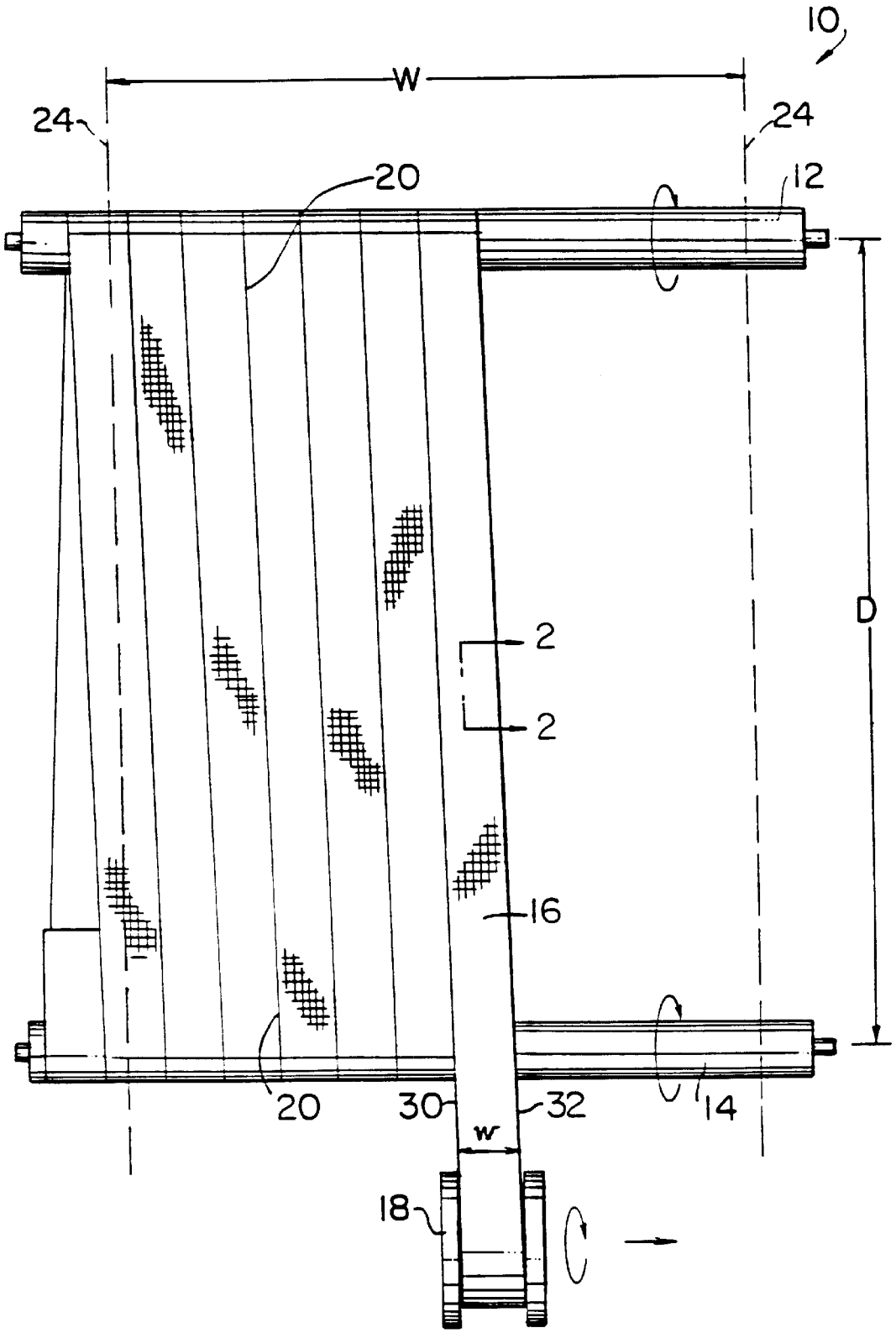
FIG. 1 is a schematic top plan view illustrating a method for manufacturing one of the layers of the base fabric of the multiaxial press fabric of the present invention.

Referring now to the several figures, FIG. 1 is a schematic top plan view illustrating a method for manufacturing one of the layers of the base fabric of the multiaxial press fabric of the present invention. The method may be practiced using an apparatus 10 comprising a first roll 12 and a second roll 14, which are parallel to one another and which may be rotated in the directions indicated by the arrows. A woven fabric strip 16 is wound from a stock roll 18 around the first roll 12 and the second roll 14 in a continuous spiral. It will be recognized that it may be necessary to translate the stock roll 18 at a suitable rate along second roll 14 (to the right in FIG. 1) as the fabric strip 16 is being wound around the rolls 12,14.

Figure 4:
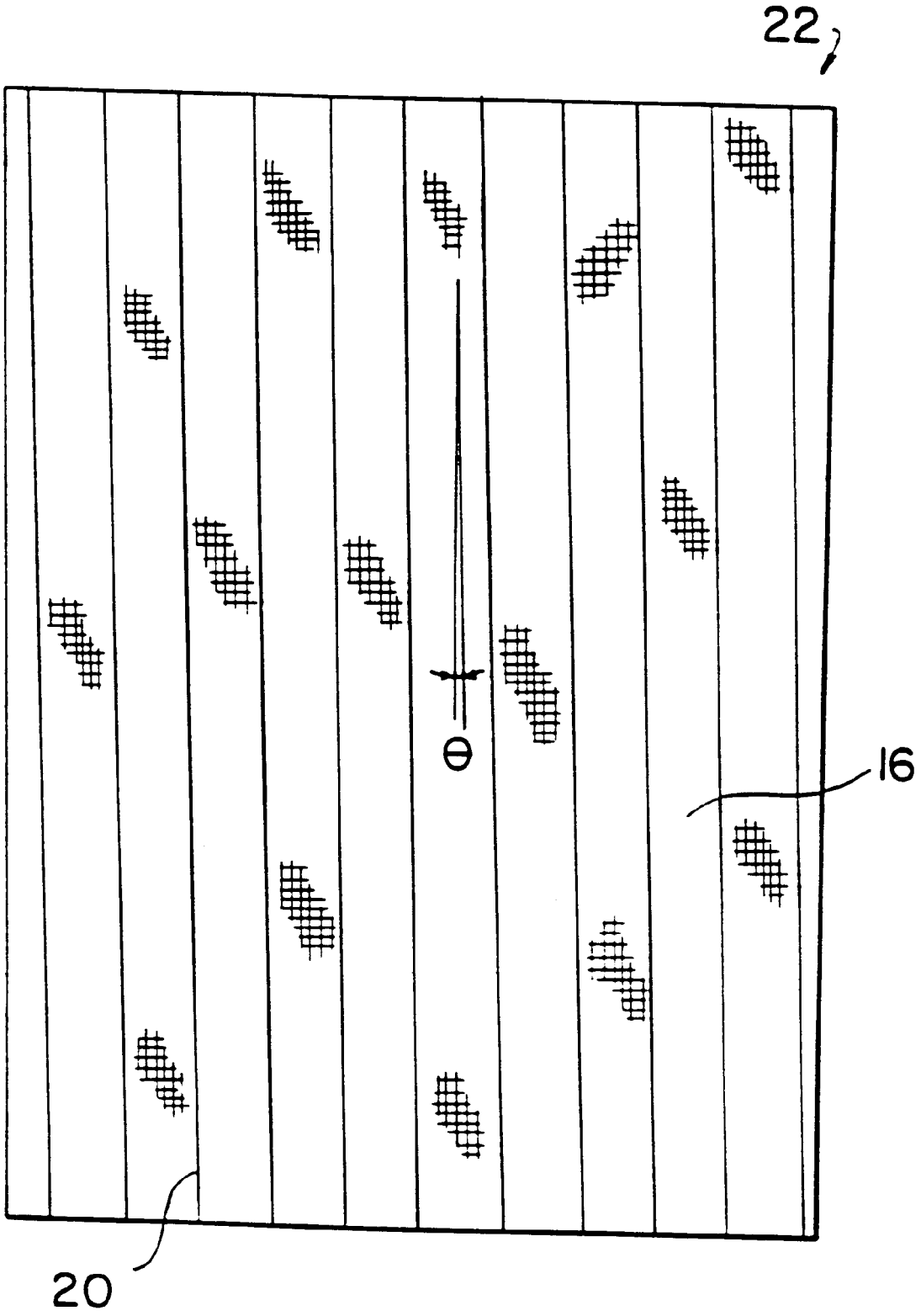
FIG. 4 is a top plan view of a finished layer of the base fabric.

The first roll 12 and the second roll 14 are separated by a distance D, which is determined with reference to the total length required for the base fabric layer being manufactured, the total length being measured longitudinally (in the machine direction) about the endless-loop form of the layer. Woven fabric strip 16, having a width w, is spirally wound onto the first and second rolls 12,14 in a plurality of turns from stock roll 18, which may be translated along the second rolls 14 in the course of the winding. Successive turns of the fabric strip 16 are abutted against one another and are attached to one another along helically continuous seam 20 by sewing, stitching, melting or welding to produce base fabric layer 22 as shown in FIG. 4. When a sufficient number of turns of the fabric strip 16 have been made to produce layer 22 in the desired width W, that width being measured transversely (in the cross-machine direction) across the endless-loop form of the layer 22, the spiral winding is concluded. The base fabric layer 22 so obtained has an inner surface, an outer surface, a machine direction and a cross-machine direction. Initially, the lateral edges of the base fabric layer 22, it will be apparent, will not be parallel to the machine direction thereof, and must be trimmed along lines 24 to provide the layer 22 with the desired width W, and with two lateral edges parallel to the machine direction of its endless-loop form.

Fabric strip 16 is woven from lengthwise yarns and crosswise yarns. Either the lengthwise yarns or the crosswise yarns, or both the lengthwise yarns and the crosswise yarns, are shaped yarns of one of the varieties to be described below. Fabric strip 16 may also include monofilament, plied monofilament or multifilament yarns. Both these latter yarns and the shaped yarns are extruded from a synthetic polymeric resin, such as polyester or polyamide. Fabric strip 16 may be woven in the same manner as are other fabrics used in the papermaking process, and may be of a single- or multi-layer weave. After weaving, the fabric may be heatset in a conventional manner prior to interim storage on stock roll 18.

Alternatively, fabric strip 16 may be woven and heatset in a conventional manner, and fed directly to apparatus 10 from a heatset unit without interim storage on a stock roll 18. It may also be possible to eliminate heatsetting with the proper material selection and product construction (weave, yarn sizes and counts). In such a situation, fabric strip 16 would be fed to the apparatus 10 from a weaving loom without interim storage on a stock roll 18.

Figure 2:
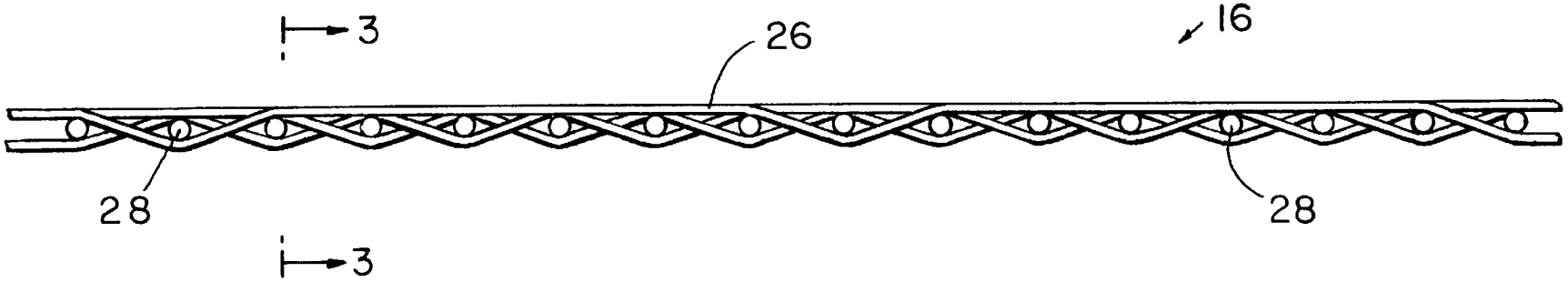
FIG. 2 is a cross-sectional view taken as indicated by line 2—2 in FIG. 1.

FIG. 2 is a cross section of a fabric strip 16 taken as indicated by line 2—2 in FIG. 1. It comprises lengthwise yarns 26 and crosswise yarns 28, interwoven in a 7-shed, single-layer weave. Crosswise yarns 28 are represented as monofilaments of circular cross section, although, it should be understood, they may be either plied monofilament yarns or multifilament yarns, or shaped yarns of one of the varieties to be described below.

Figure 3:
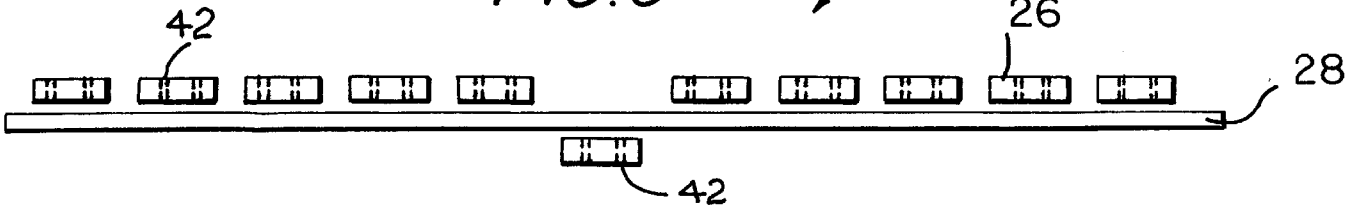
FIG. 3 is a cross-sectional view taken as indicated by line 3—3 in FIG. 2.

FIG. 3 is a cross section taken as indicated by line 3—3 in FIG. 2. Lengthwise yarns 26, now seen in cross section, are shaped yarns; that is, more specifically, lengthwise yarns 26 are monofilament yarns of substantially rectangular cross direction. Perforations 42 pass through the lengthwise yarns 26. Together with the illustrated 7-shed weave pattern, these flat monofilament yarns give the fabric strip an extremely smooth surface on the side (top in the figure) on which the lengthwise yarns 26 make long floats over the crosswise yarns 28. It should be understood, however, that fabric strip 16 may be woven according to any of the weave patterns commonly used to weave paper machine clothing.

Because the fabric strip 16 is spirally wound to assemble base fabric layer 22, lengthwise yarns 26 and crosswise yarns 28 do not align with the machine and cross-machine directions, respectively, of the layer 22. Rather, the lengthwise yarns 26 make a slight angle, θ, whose magnitude is a measure of the pitch of the spiral windings of the fabric strip 16, with respect to the machine direction of the layer 22, as suggested by the top plan view thereof shown in FIG. 4. This angle, as previously noted, is typically less than 10°. Because the crosswise yarns 28 of the fabric strip 16 generally cross the lengthwise yarns 26 at a 90° angle, the crosswise yarns 28 make the same slight angle, θ, with respect to the cross-machine direction of the layer 22.

Woven fabric strip 16 has a first lateral edge 30 and a second lateral edge 32 which together define the width of the body of the woven fabric strip 16. As the fabric strip 16 is being spirally wound onto the first and second rolls 12, 14, the first lateral edge 30 of each turn is abutted against the second lateral edge 32 of the immediately preceding turn and attached thereto.

Figure 5:
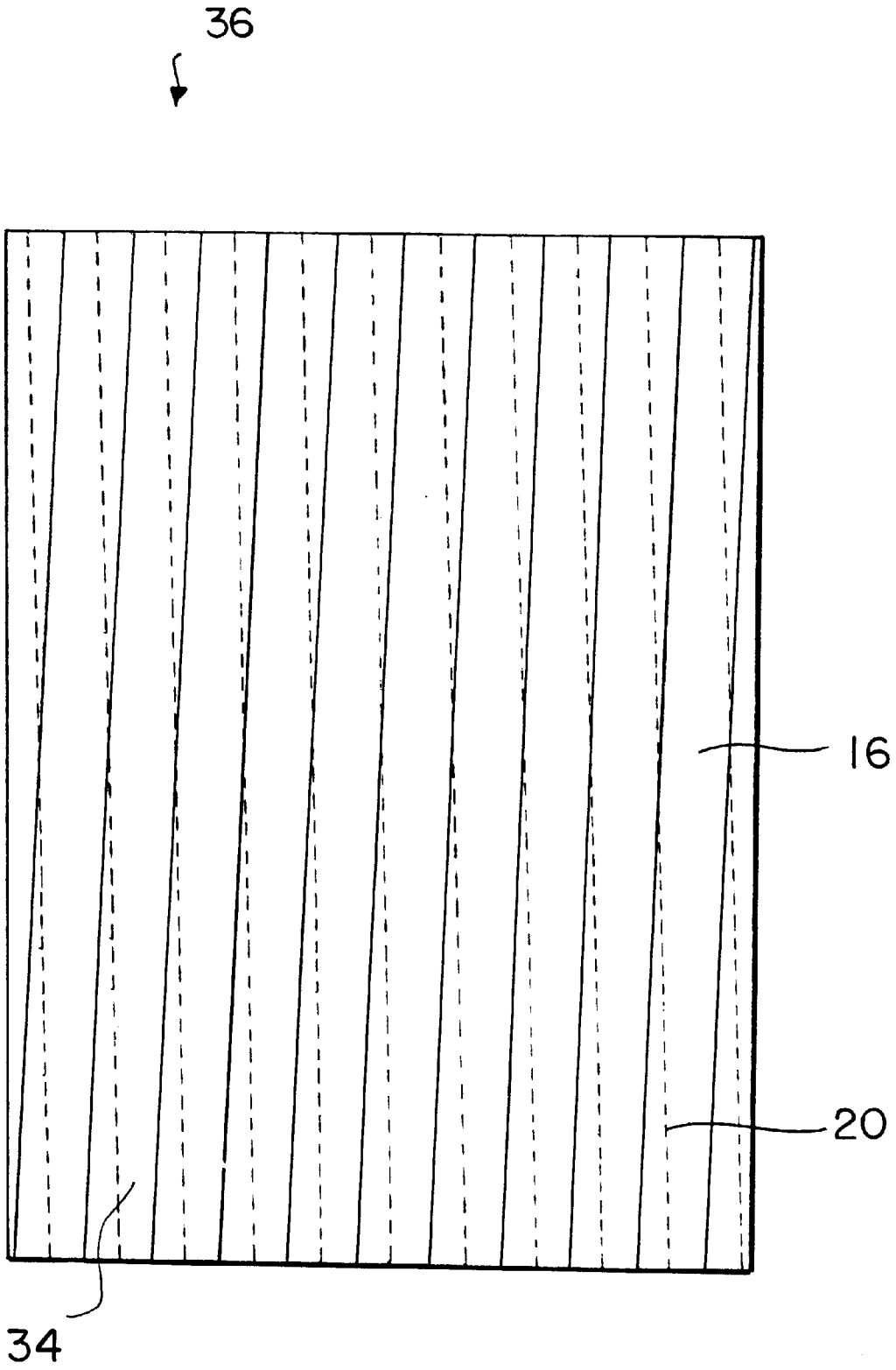
FIG. 5 is a top plan view of a two-layer, laminated base fabric for the multiaxial press fabric of the present invention.

In a preferred method, if desired, a second base fabric layer for the multiaxial press fabric of the present invention may be provided on top of base fabric layer 22 before removing base fabric layer 22 from apparatus 10. The second base fabric layer 34 may be fashioned in the same manner as is described above. Preferably, second base fabric layer 34 is manufactured to spiral in a direction opposite to that of base fabric layer 22 by starting at the right side of second roll 14 in FIG. 1, rather than at the left side, as was the case for the manufacture of base fabric layer 22, and by translating stock roll 18 at a suitable rate to the left along second roll 14 as the fabric strip 16 is being wound around the rolls 12,14. It will be appreciated that fabric strip 16 will have to be wound in a sufficient number of turns to completely cover base fabric layer 22, and that the lateral edges of second base fabric layer 34 will have to be trimmed to be rendered parallel to the machine direction and to conform to those of base fabric 22. The result is shown in FIG. 5, where helically continuous seam 20 of base fabric layer 22 is shown as a dashed line. Additional layers, spiralling in either direction, may be provided in the same manner.

The two-layer, laminated base fabric 36 shown in FIG. 5 therefore comprises a second base fabric layer 34 which overlies the first base fabric layer 22. The lengthwise (warp) yarns 26 in fabric strip 16 in both layers 22,34 make relatively small angles with respect to the machine direction (MD) of base fabric 36, and, because first layer 22 and second layer 34 spiral in opposite directions, cross each other at a relatively small angle that is equal to the sum of the angles each makes with the machine direction. Similarly, the crosswise (filling) yarns 28 in the fabric strip 16 in both layers 22,34 make small angles with respect to the cross-machine direction (CD) of base fabric 36, and cross each other at a relatively small angle that is equal to the sum of the angles each makes with the cross-machine direction. As a consequence, the two-layer, laminated base fabric 36 has no defined machine- or cross-machine-direction yarns. Instead, lengthwise (warp) yarns 26 and crosswise (filling) yarns 28 of the first and second layers 22,34 lie in four different directions at oblique angles to the machine and cross-machine directions. For this reason, base fabric 36 is considered to be multiaxial.

Figure 6:
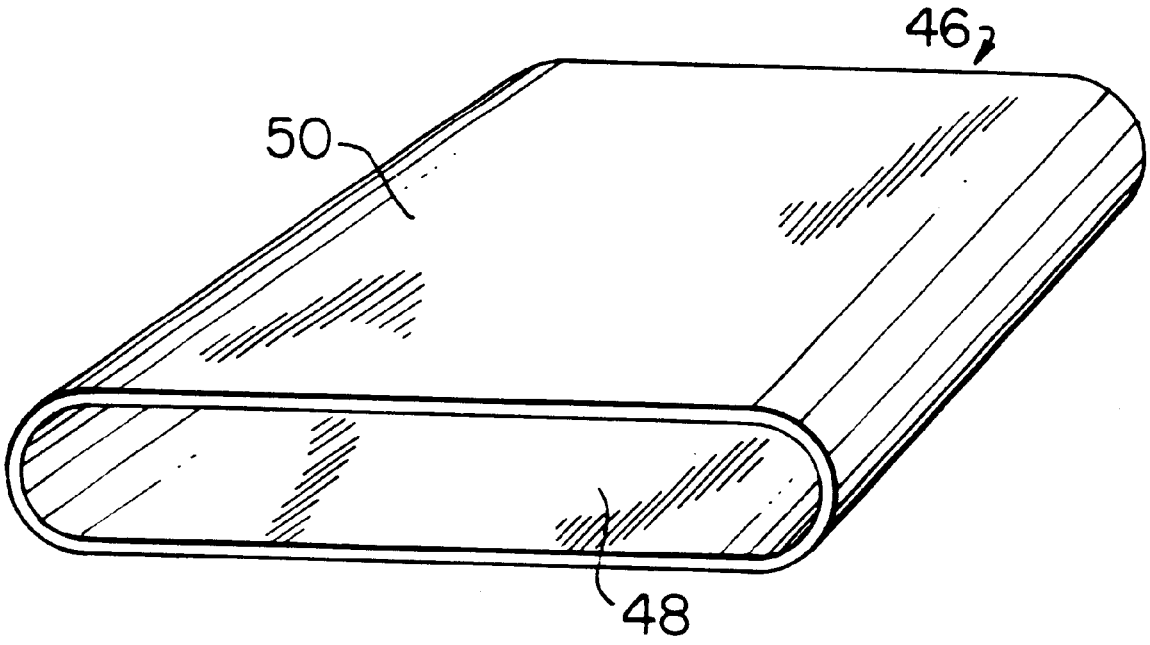
FIG. 6 is a perspective view of the multiaxial press fabric of the present invention.

FIG. 6 is a perspective review of a multiaxial press fabric 46 of the present invention. Press fabric 46 is in the form of an endless loop having an inner surface 48 and an outer surface 50, and comprises base fabric 36.

The outer surface 50 of multiaxial press fabric 46 has a plurality of layers of staple fiber material attached thereto by needling. The needling of the layers of staple fiber material into the outer surface 50 of the press fabric 46 also attaches the first and second layers 22, 34 of the base fabric 36 to one another, as the needling drives individual fibers of the staple fiber material into and through the overlying first and second layers 22, 34. The staple fiber material may be of polyamide, polyester or any of the other varieties of staple fiber used by those of ordinary skill in the art to manufacture paper machine clothing. In general, one or both of the inner and outer surfaces of the press fabric have a plurality of layers of staple fiber material attached thereto by needling.

Returning now to the shaped yarns included in the strip of woven fabric used to produce the multiaxial press fabric of the present invention, the shaped yarns are included in at least one of the lengthwise (warp) and crosswise (filling) directions of the fabric strip 16. The shaped yarns may be monofilament yarns of substantially rectangular cross section, as was the case with the lengthwise yarns 26 seen above in FIG. 3.

The shaped yarns of substantially rectangular cross section may, for example, have a width in the range from 0.25 mm to 0.50 mm, and a thickness in the range from 0.12 mm to 0.25 mm. Shaped yarns having a width greater than 0.50 mm may be used; where this is the case, the shaped yarns may be perforated to permit water to pass therethrough as well as around the yarns.

As implied above, shaped yarns of rectangular cross section provide an extended yarn surface for maximum sheet pressure uniformity within the press nip. The yarn surface, being elongated, will wear at a reduced rate, thereby extending the useful life of the fabric. An additional advantage of the use of these yarns is that they make the press fabric thinner than would be the case if yarns of circular cross section were used. This lower thickness, increased sheet pressure uniformity, and the incompressible nature of a multiaxial fabric of more than one layer make the multiaxial fabric especially useful in presses of the long nip shoe press type having a grooved shoe press belt.

Figure 7:
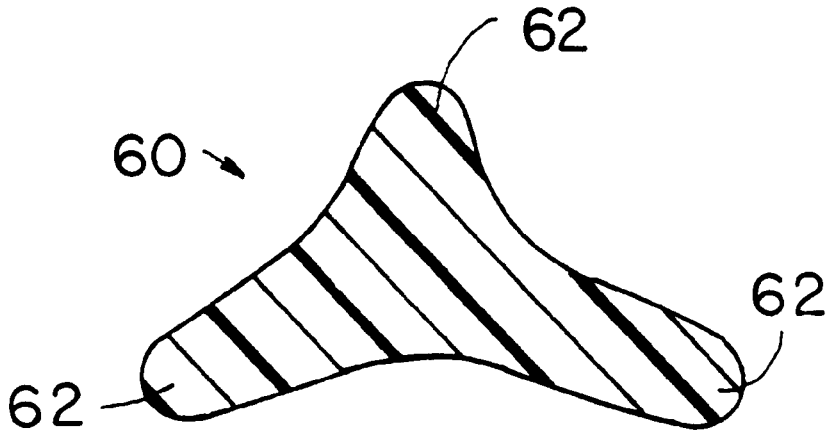
FIG. 7 is a cross-sectional view of a shaped yarn having a trilobal cross section.
Figure 8:
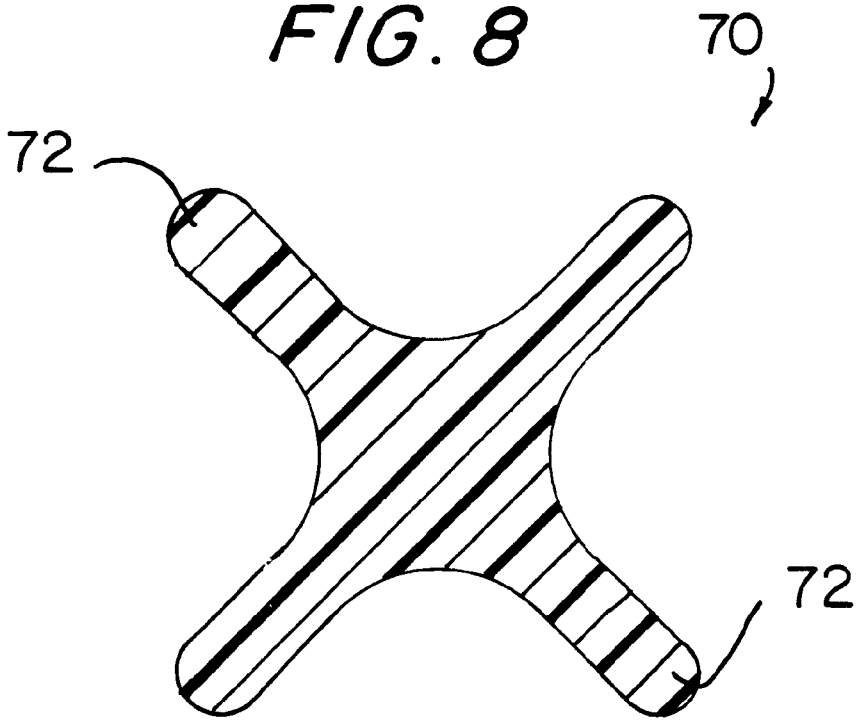
FIG. 8 is a cross-sectional view of a shaped yarn having a quadrilobal cross section.

The shaped yarns may alternatively be of trilobal cross section, as shown in FIG. 7, or of quadrilobal cross section, as shown in FIG. 8. FIG. 7 is a cross-sectional view of a monofilament 60 having a trilobal cross section. The cross-sectional view presented in FIG. 7 indicates the presence of three lobes 62. FIG. 8 is a cross-sectional view of a monofilament 70 having a quadrilobal cross section. The cross-sectional view presented in FIG. 8 indicates the presence of four lobes 72. Shaped yarns of these two types provide fabric strip 16, and ultimately the multiaxial press fabrics manufactured therefrom, with additional void volume, permitting the fabrics to accept additional amounts of water in a press nip. These yarns of the trilobal and quadrilobal cross section may have cross-sectional dimensions (or diameters) in the same ranges as those expressed above for the yarns of substantially rectangular cross section.

Figure 9:
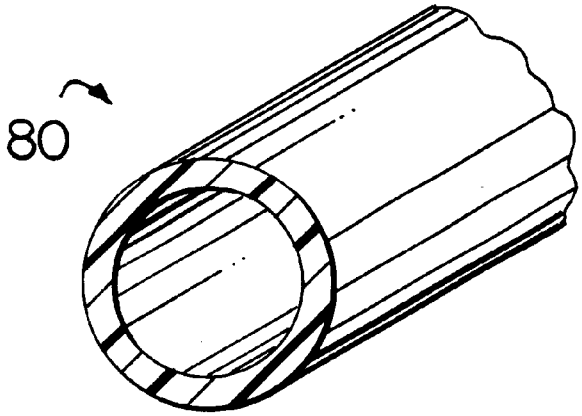
FIG. 9 is a cross-sectional view of a hollow yarn.

Further, the shaped yarns may be hollow yarns of circular or some other cross-sectional shape. FIG. 9 is a cross-sectional view of such a hollow yarn 80, which may have a diameter in the range from 0.020 mm to 0.050 mm. The presence of this kind of yarn in either direction in the fabric strip will allow the multiaxial press fabric 46 to compress in a press nip. In some applications, such compressibility is required to assist the water removal process.

Modifications to the multiaxial press fabric of the present invention would be obvious to those of ordinary skill in the art, but would not bring the invention so modified beyond the scope of the appended claims. For example, the base fabric thereof may comprise, in addition to one or more spirally wound layers, one or more layers of standard base fabric. That is to say, one or more additional layers may be formed by fabrics having machine- and cross-machine direction yarns and produced by techniques well-known to those of ordinary skill in the art. Such a fabric may be woven endless in the dimensions required for the paper machine for which it is intended, or flat woven and subsequently rendered into endless form with a woven seam. It may also be produced by a modified endless weaving technique to be on-machine-seamable. Laminated fabrics, having one or more standard base fabric layers, may also be used.

What is claimed is:

1. A multiaxial press fabric for the press section of a paper machine, said multiaxial press fabric comprising:

a base fabric, said base fabric having a first layer, said first layer comprising a first fabric strip, said first fabric strip being woven from lengthwise and crosswise yarns wherein at least one of said lengthwise and crosswise yarns are shaped yarns, said first fabric strip having a first lateral edge and a second lateral edge, said first fabric strip being spirally wound in a plurality of contiguous turns wherein said first lateral edge in a turn of said first fabric strip abuts said second lateral edge of an adjacent turn thereof, thereby forming a helically continuous seam separating adjacent turns of said first fabric strip, said helically continuous seam being closed by attaching abutting first and second lateral edges of said first fabric strip to one another, thereby providing said first layer and said base fabric in the form of an endless loop having a machine direction, a cross-machine direction, an inner surface and an outer surface; and a plurality of layers of staple fiber material attached to one of said inner and outer surfaces of said base fabric, wherein said shaped yarns are monofilament yarns of a non-circular cross section, wherein said non-circular cross section is of a substantially rectangular shape, and wherein said shaped yarns are perforated.

2. A multiaxial press fabric as claimed in claim 1, said base fabric further comprising a second layer, said second layer comprising a second fabric strip, said second fabric strip being woven from lengthwise and crosswise yarns wherein at least one of said lengthwise and crosswise yarns are shaped yarns, said second fabric strip having a first lateral edge and a second lateral edge, said second fabric strip being spirally wound in a plurality of contiguous turns wherein said first lateral edge in a turn of said second fabric strip abuts said second lateral edge of an adjacent turn thereof, thereby forming a helically continuous seam separating adjacent turns of said second fabric strip, said helically continuous seam being closed by attaching abutting first and second lateral edges of said second fabric strip to one another, thereby providing said second layer in the form of an endless loop having a machine direction, a cross-machine direction, an inner surface and an outer surface, said endless loop formed by said second layer being around said endless loop formed by said first layer.

3. A multiaxial press fabric as claimed in claim 2 wherein said second fabric strip is spirally wound in a direction opposite to that in which said first fabric strip is spirally wound.

4. A multiaxial press fabric as claimed in claim 1 wherein said base fabric further comprises a standard base fabric having machine-direction and cross-machine-direction yarns, said standard base fabric being in the form of an endless loop having a machine direction, a cross-machine direction, an inner surface and an outer surface.

5. A multiaxial press fabric as claimed in claim 4 wherein said endless loop formed by said standard base fabric is within said endless loop formed by said first layer.

6. A multiaxial press fabric as claimed in claim 4 wherein said standard base fabric is woven endless.

7. A multiaxial press fabric as claimed in claim 4 wherein said standard base fabric is on-machine-seamable.

8. A multiaxial press fabric as claimed in claim 1 wherein said first fabric strip is of a single-layer weave.

9. A multiaxial press fabric as claimed in claim 1 wherein said first fabric strip is of a multi-layer weave.

10. A multiaxial press fabric as claimed in claim 1 wherein said lengthwise yarns and said crosswise yarns of said first fabric strip are of a synthetic polymeric resin.

11. A multiaxial press fabric as claimed in claim 1 wherein said first layer of said base fabric has lateral edges trimmed in a direction parallel to said machine direction thereof.

12. A multiaxial press fabric as claimed in claim 1 wherein said first fabric strip makes an angle of less than 10° with respect to said machine direction of said first layer.

13. A multiaxial press fabric as claimed in claim 2 wherein said second fabric strip is of a single-layer weave.

14. A multiaxial press fabric as claimed in claim 2 wherein said second fabric strip is of a multi-layer weave.

15. A multiaxial press fabric as claimed in claim 2 wherein said lengthwise yarns and said crosswise yarns of said second fabric strip are of a synthetic polymeric resin.

16. A multiaxial press fabric as claimed in claim 2 wherein said second layer of said base fabric has lateral edges trimmed in a direction parallel to said machine direction thereof.

17. A multiaxial press fabric as claimed in claim 2 wherein said second fabric strip makes an angle of less than 10° with respect to said machine direction of said second layer.

18. A multiaxial press fabric as claimed in claim 4 wherein said standard base fabric is of a single-layer weave.

19. A multiaxial press fabric as claimed in claim 4 wherein said standard base fabric is of a multi-layer weave.

20. A multiaxial press fabric as claimed in claim 4 wherein said standard base fabric is a laminated fabric.

21. A multiaxial press fabric as claimed in claim 4 wherein said lengthwise yarns and said crosswise yarns of said standard base fabric are of a synthetic resin.

22. A multiaxial press fabric as claimed in claim 1 further comprising a plurality of layers of staple fiber material attached to both of said inner and outer surfaces of said base fabric.

23. A multiaxial press fabric as claimed in claim 1 wherein said staple fiber material is of a polymeric resin material.

24. A multiaxial press fabric as claimed in claim 23 wherein said polymeric resin material is selected from the group consisting of polyamide and polyester resins.

25. A multiaxial press fabric as claimed in claim 22 wherein said staple fiber material is of a polymeric resin material.

26. A multiaxial press fabric as claimed in claim 25 wherein said polymeric resin material is selected from the group consisting of polyamide and polyester resins.

27. A multiaxial press fabric as claimed in claim 2 wherein said shaped yarns of said second layer are monofilament yarns of a non-circular cross section.

28. A multiaxial press fabric as claimed in claim 27 wherein said non-circular cross section of said shaped yarn of said second layer is of a substantially rectangular shape.

29. A multiaxial press fabric as claimed in claim 27 wherein said non-circular cross section has a plurality of lobes.

30. A multiaxial press fabric as claimed in claim 29 wherein said plurality is three.

31. A multiaxial press fabric as claimed in claim 29 wherein said plurality is four.

32. A multiaxial press fabric as claimed in claim 2 wherein said shaped yarns of said second layer are hollow yarns.

33. A multiaxial press fabric as claimed in claim 28, wherein said shaped yarn of said second layer is perforated.

* * * * *